US006758627B2

(12) United States Patent
King

(10) Patent No.: US 6,758,627 B2
(45) Date of Patent: Jul. 6, 2004

(54) GUARD RAIL SUPPORT, ATTACHMENT, AND POSITIONING SPACER BLOCK

(75) Inventor: David T. King, Elizabethtown, KY (US)

(73) Assignee: K.E.S.S. Inc., Elizabethtown, KY (US)

( * ) Notice: Subject to any disclaimer, the term of this patent is extended or adjusted under 35 U.S.C. 154(b) by 0 days.

(21) Appl. No.: 10/001,903

(22) Filed: Nov. 15, 2001

(65) Prior Publication Data

US 2002/0094235 A1 Jul. 18, 2002

Related U.S. Application Data

(60) Provisional application No. 60/249,037, filed on Nov. 15, 2000.

(51) Int. Cl.[7] ..... E01F 13/00

(52) U.S. Cl. ..... 404/6; 256/1; 256/13.1

(58) Field of Search ..... 256/1, 13.1; 404/6

(56) References Cited

U.S. PATENT DOCUMENTS

| | | | | |
|---|---|---|---|---|
| 2,056,842 | A | 10/1936 | Edgecomb | |
| 2,603,455 | A | 7/1952 | Welch | |
| 2,701,127 | A | 2/1955 | Elliot | |
| 3,317,189 | A | 5/1967 | Rubenstein | |
| 3,360,244 | A | 12/1967 | Bucker | |
| 3,493,213 | A | 2/1970 | Ackerman | |
| 3,591,144 | A | 7/1971 | Iving | |
| 3,603,562 | A | 9/1971 | Glaesener | |
| 3,704,861 | A | 12/1972 | Glaesener | |
| 3,784,167 | A | 1/1974 | Glaesener | |
| 3,825,218 | A | 7/1974 | Krumbein et al. | |
| 3,825,229 | A | 7/1974 | Bartlett et al. | |
| 3,963,218 | A | 6/1976 | Glaesener | |
| 3,982,735 | A | 9/1976 | Fornells | |
| 4,047,701 | A | 9/1977 | Glaesener | |
| 4,063,713 | A | * 12/1977 | Anolick et al. | 248/66 |
| 4,090,694 | A | 5/1978 | Vincent | |
| 4,138,093 | A | 2/1979 | Meinzer | |
| 4,298,075 | A | 11/1981 | Sweeney | |
| 4,312,600 | A | 1/1982 | Schaaf et al. | |
| 4,406,563 | A | 9/1983 | Urlberger | |
| 4,553,875 | A | 11/1985 | Casey | |
| 4,684,107 | A | 8/1987 | Robbins, Jr. | |
| 4,739,971 | A | 4/1988 | Ruane | |
| 4,986,694 | A | 1/1991 | Delamere | |
| 5,152,507 | A | 10/1992 | Lee | |
| 5,195,727 | A | 3/1993 | Liao et al. | |
| 5,203,543 | A | 4/1993 | Fleury | |
| 5,219,241 | A | 6/1993 | Picton | |
| 5,261,647 | A | 11/1993 | Venegas, Jr. et al. | |
| 5,277,516 | A | 1/1994 | Strieter | |
| 5,284,236 | A | 2/1994 | Ohta et al. | |
| 5,336,016 | A | 8/1994 | Baatz | |
| 5,402,987 | A | 4/1995 | Duyck et al. | |
| 5,429,449 | A | 7/1995 | Baatz | |
| 5,503,496 | A | 4/1996 | Voigt | |
| 5,507,473 | A | 4/1996 | Hammer et al. | |
| 5,791,811 | A | 8/1998 | Yoshino | |
| 6,007,269 | A | 12/1999 | Marinelli | |
| 6,010,275 | A | 1/2000 | Fitch | |
| 6,036,399 | A | 3/2000 | Schaek | |
| 6,168,346 | B1 | 1/2001 | Ernsberger | |
| 6,179,279 | B1 | * 1/2001 | Asai et al. | 269/164 |
| 6,220,576 | B1 | * 4/2001 | Chan | 256/13.1 |
| 6,308,936 | B1 | * 10/2001 | Atwood | 256/1 |
| 6,561,492 | B1 | * 5/2003 | Hubbell | 256/13.1 |

* cited by examiner

*Primary Examiner*—Gary S. Hartmann
(74) *Attorney, Agent, or Firm*—David W. Carrithers; Carrithers Law Office, PLLC

(57) ABSTRACT

The guard rail support attachment and positioning block or spacer block is used to space guard railing away from posts such as "I" beams which are driven into the ground. The spacer block keeps automobile wheels from impacting the I beams and initiating a roll of the vehicle. The spacer block is a generally rectangular block or cube including corded-out cavities to reduce weight and tabs or projections which cooperatively engage the side of the post and the edge of the guard rail to position and hold same in position for attachment with holding members such as bolts. Webbing can be used to provide structural support within the cavity. The spacer block may be formed by low pressure injection molding to form a structural foam spacer block to optimize the strength to weight characteristics of the spacer block. The spacer block may be formed of a virgin and/or recycled plastic material and/or include virgin or recycled rubber material such as from obtained from the regrind of used tires and/or another elastomeric material from other sources.

15 Claims, 4 Drawing Sheets

GUARD RAIL SUPPORT, ATTACHMENT, AND POSITIONING SPACER BLOCK

This application claims priority from U.S. provisional application Serial No. 60/249,037 filed on Nov. 15, 2000.

BACKGROUND OF THE INVENTION

1. Technical Field

This device relates to spacer blocks for attachment of guard rails to support posts.

2. Description of the Prior Art

Guard rails are typically installed along highways as a roadway safety barrier system. The guard rails are usually formed as strips of material, typically extruded metal about 12 feet long and weighting about 90 pounds. A preferred embodiment comprises an elongated strip of metal, usually composed of galvanized steel, (typically about 12 gauge), aluminum, steel, fiber glass, or even synthetic materials. At least one configuration of a guard rail used includes a corrugation forming an undulating cross section in order to absorb energy upon receiving an impact from an out of control vehicle to prevent or at least control the direction of the vehicle prior to its leaving the roadway. Typically these beams are about 9 inches wide, have two crowns and are shaped substantially like the letter "W". An alternate corrugated guard rail is known in the industry as a thrie beam which has three crowns and is about a third wider than the conventional two crown guard rail. Usually a plurality of guard rails will be linked together horizontally at their distal ends, either end to end, or overlapping, and be supported by a plurality of vertically oriented posts which are typically "I-beamed" shaped, round, or square posts which are driven into the ground spaced apart a selected distance from the edge of the road. Of course, posts are also fabricated from aluminum, wood, or other metals and could be formed from polymers or fiberglass materials. The posts are usually driven into the ground and typically will yield under a desired amount of pressure and move within the ground or bend in accordance with the deformation of the guard rail rather than break off at ground level, in order to assist the rail in dissipating force upon receiving a blow from a vehicle.

Typically a spacer block is disposed between the guard rail and the post to support the guard rail at a selected distance from the post to prevent an uncontrolled vehicle from hitting and entangling the posts. Thus, the spacer block keeps the automobile wheels from impacting the posts and initiating a roll of the vehicle. Moreover, the guard rail provides a continuous rail or track for guiding the vehicle providing at least some response time for the driver to regain control of the vehicle before leaving the roadway.

The most popular material spacer blocks are made out of is wood. Some of the problem with wood is it deteriorates over time, it is heavy, it can give installers splinters, it contracts and expands with season changes. Also, wood tends to leach out chemicals typically used for pressure treating which may be toxic to the environment. Conventional plastic blocks on the market today are typically wood block designs made out of plastic.

It typically requires two to three people to install a 12 foot section of guard railing to posts when using conventional spacer blocks, one to hold the guard rail and another to align and hold the spacer block in position with the post and a third person to insert bolts therethrough securing same.

The instant invention provides a spacer block having improved strength, reduced weight, and competitive cost.

Furthermore, the spacer block of the present invention was designed with the assembly process in mind in order to enable a single individual to erect a guard rail safety barrier system on spacer blocks supported by posts.

SUMMARY OF THE INVENTION

The guard rail support attachment and positioning block or spacer block is used to space guard railing away from posts such as "I" beams which are driven into the ground.

The spacer block of the instant invention provides a design that is strong yet light, which makes it installation friendly, reduces the cost of manufacture, and permits one person to install a section of guardrail. In the past it might require two or three people to hold the rail and mount it to the spacer block and support post.

Plastic properties are different from wood and requires a design that takes advantage of the different properties. The present design is specific for plastic, (polyethylene, PVC, polypropylene polyethylene terphthalate, nylon), or plastic/rubber and will out perform the wood design in all performance specifications. Moreover, the resiliency, elasticity, flexibility, and ability to be impervious to weathering elements, extend longtivity, and require little or no maintenance are important features of the present invention.

A preferred embodiment to the spacer block of the instant invention is a generally rectangular block or cube including corded-out cavities to reduce weight and one or more tabs on the top and/or sides projecting outwardly for cooperatively engaging the sides and top edge of the post. A preferred embodiment is approximately 4 inches in width which is the same as conventional I-beam posts providing a lightweight, compact, high strength spacer block as compared to conventional spacer blocks made from wood or plastic typically having a width of 6 inches or more. A tab projecting outward from the face of the spacer block provides a support member to hold, steady, and even align the guard rail which rests thereon providing a means for one individual to mount the guard rail on spacer blocks, whereas conventional spacer blocks do not support the guard rail prior to attachment thereto and require at least two individuals if not three to attach the guard rail to the spacer block and post.

The preferred embodiment of the spacer block of the present invention comprises one or more polymers, such as (polyethylene, polypropylene, polyethylene terephthalate, nylon, polyurethane, polyvinyl chloride, and mixtures thereof), and preferably a polymer/rubber blend. Other plastic materials which may be used may be selected from ABS, Acetyl, polypropylene oxide, nylon PBT, polycarbonate, polystyrene, modified polyphenylene oxide, polyester, fiberglass filled nylon, fiberglass filled styrene, fiberglass filled SAN, acrylic, ethylene copolymers, ionomers, and polysulfone. Of course the spacer block of the present invention may be formed of a single type of polymer or mixtures of various polymers. The polymers may be virgin material or the spacer block may be composed of at least some if not all of regrind materials, such as reground polyethylene, ethylene. The rubber and/or elastomeric compound which can be incorporated in the formulation may be comprised of a natural rubber or synthetic rubber, either virgin, regrind material or combinations thereof. It is contemplated that fiberglass may also be used as an additive or substitute raw material for all or at least a portion of the plastic material. Fillers such as wood chips. sawdust, calcium carbonate may also be used. The rubber from used tires have been a huge problem for the environment and could be utilized as the source of rubber for the instant invention. Moreover, the spacer blocks may themselves be recyclable.

One preferred embodiment of the present invention is a spacer block utilizing a blend of at least one polymer including one or more of the plastic materials set forth heretofore, together with at least one rubber or elastomeric materials mixed and molded together with the polymer(s). The ability to mold large blocks of plastic containing virgin, and/or regrind thermoplastics which can be obtained from reusable containers, alone or together with virgin or grind rubber from used tires or other sources providing a useful means of disposal and recycling of waste products. One preferred embodiment of the invention utilizes grind rubber in combination with a one or more thermoplastics extruded or molded by low pressure injection molding or vacuum forming. The molding process is believed to encapsulate the rubber particles with the thermoplastic melt thereby providing a stronger blended product with enhanced performance capabilities as compared to a simple mixture of thermoplastic and rubber particles compressed together under high pressure. One source of the grind rubber is reground vehicle tires, representing a new method of disposal of used tires.

Another important aspect of the present invention, is the molding of the spacer blocks using a structural foam process to further increase strength, reduce costs, and reduce the weight of the spacer blocks. The structural foam techniques utilizes a gas and/or chemical foaming agent injection process in the molding operation to form a foam core creating structural support webbing between solid plastic skins to increase structural strength and reduce weight and cost. The design of the block to include structural external webbing between void spaces in the spacer blocks of the instant invention further provides strength and weight advantages to the space block. The use of the blend of plastics and rubber and/or the webbing within the block cavity are unique features; however, in addition the utilization of structural foam forming the skin provides another novel feature not utilized in spacer blocks taught in the prior art.

These embodiments of the present invention can be utilized with a spacer block molded having solid walls as well as a spacer block molded by structural foam whereby the walls are composed of an inner and outer skin with webbing thereinbetween.

It is contemplated that all or at least a portion of the spacer block 10 could be filled with foam, gel, finely ground solid material, or even a liquid such as water and/or alcohol and water such as a glycol to inhibit freezing, or that the cavity could contain a bag containing same to cushion and absorb impact thereto. The material could be contained within the spacer block body or insertion of a container into the webbing or cavity formed within the spacer block could even be removable, such as a water bag or a deformable plastic container such as a jug. Moreover, a cellular core could be utilized for impact absorption within the cavities, or an impact absorbing block filled with cellular material, a gel, or a liquid could be disposed within the cavities formed in the present spacer blocks.

Conventional spacer block assemblies require one person to hold the wood block while another holds the guardrail section and a third person installs the bolt, which holds the entire assembly together. The instant invention includes a hanger enabling the spacer block to hang on the I beam by itself. On the bottom of the spacer block is a guard rail resting tab so that the guard rail can be lifted and placed on the resting tab for mounting to the spacer block and post.

One person can install a section by placing the bolt with in hands reach, it is possible for one person to lift a section of guardrail and rest it on the rail tab and install the bolt. A section of guardrail can be installed by a single person at a much faster pace than the designs of today. Therefor, it is an objective of the present invention to provide a spacer block which enables one person to mount a guard rail to a spacer block and post.

It is another objective of the present invention to provide a spacer block which is splinter-less, has a longer life span than wood, lighter than wood.

It is an object of the present invention to provide a plastic/rubber composite block which meets all required specifications set forth by the Federal Highway Administration.

It is an object of the present invention to provide a spacer block which is environmentally friendly and be capable of being manufactured using recycled plastic, tires, and/or combinations thereof.

It is an object of the present invention to provide a plastic/rubber composition which will out-last the wood blocks of today.

It is an object of the present invention to provide a plastic-rubber composite spacer block that will meet or exceed the requirements of today's wooden block.

Another important optional feature is the utilization of a plastic/rubber copolymer material to enhance the performance of the spacer block.

Yet another object of the present invention is to provide an embodiment which may be formed from structural foam in order to optimize the weight to strength of the spacer block.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

The structural integrity of the various embodiments of the spacer blocks 10 of the present invention is attributed to the lightweight composite materials and the reinforcing webbing which provides the rigidity and controlled compression of the spacer blocks 10 under load.

Figure 1:
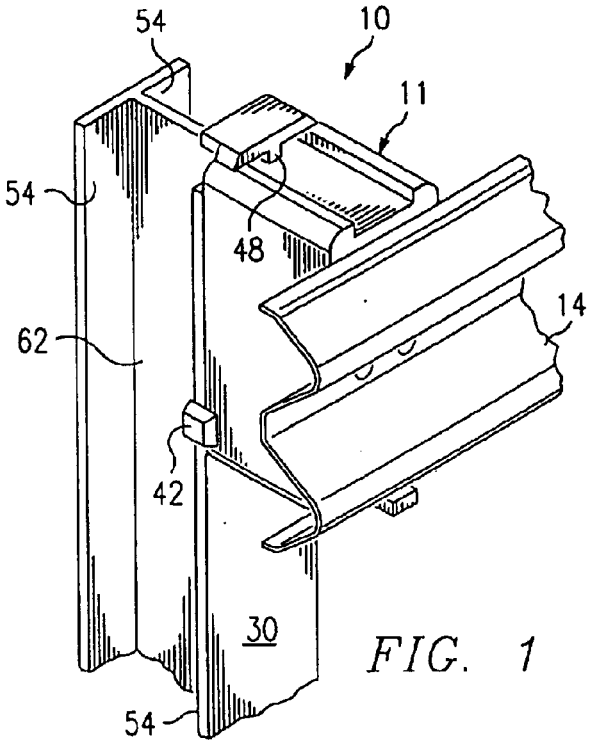
FIG. 1 is a perspective view showing the spacer block of the present invention mounted to a post and cooperatively engaging a guard rail.
Figure 2:
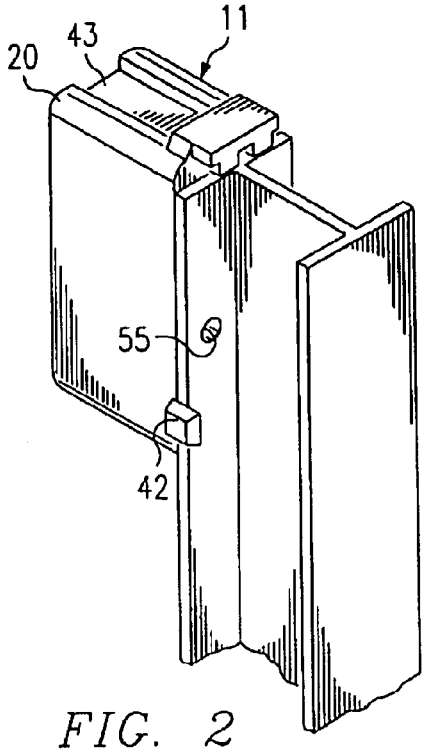
FIG. 2 is a rear perspective view showing the spacer block of FIG. 1 and the post.
Figure 3:
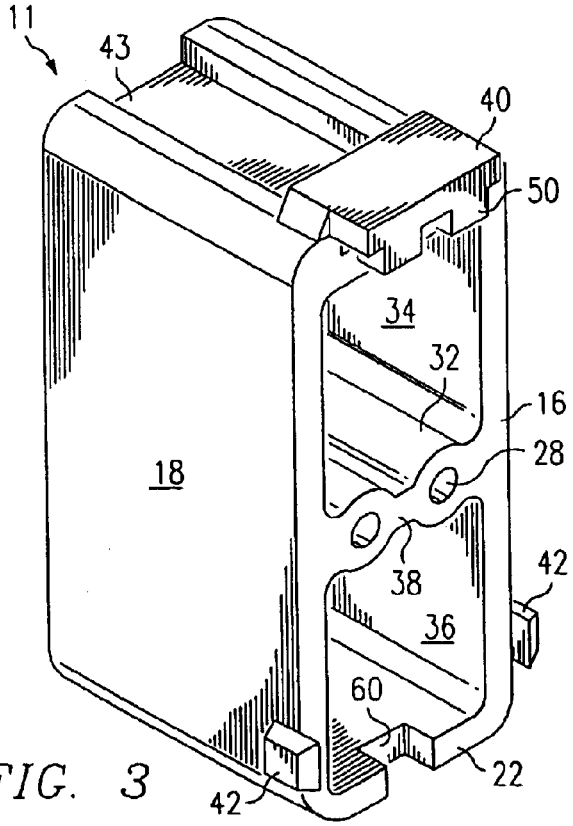
FIG. 3 is a rear perspective view showing the spacer block of FIG. 1 having a cavity formed between the top, side, and medial wall, and a cavity formed between the medial side, and bottom wall.

As illustrated in FIGS. 1 and 2, the spacer block 11 is mounted to a post 30, shown as an I-beam, and cooperatively engages and supports a guard rail 14 having an "M" shaped corrugated cross section. The spacer block 11 is shown with the removable slidable top tab 40 engaging the top edge of the I beam and the optional side tabs 42 preventing lateral movement thereof. The guard rail 14 is shown resting, positioned on the bottom tab 64 extending from the spacer block 11 supporting and aligning the guard rail 14 for attachment to the post 30 with one or more bolts extending through the through holes or bores 28 of the spacer block 11. Conventional I-beam posts 30 have a single hole punched into the flange 54 on one side of the post 30 only.

As shown in FIGS. 1–5, the spacer block 10 used for conventional two crown guard rails or other conventional longitudinal rail members is typically about four (4) inches wide, about seven and one-half (7½) inches deep, and about 14 inches long. The spacer blocks 10 of the present invention include a front face 12 constituting the surface for attachment of the guard rail 14. The front face 12 is a generally flat solid surface. Of course it is anticipated that the face 12 could be webbed, curved, or even corrugated to correspond to the shape of the guard rail 14. The front face 12 can be formed to be concave and include a longitudinal depression to fit around posts as well.

Figure 5:
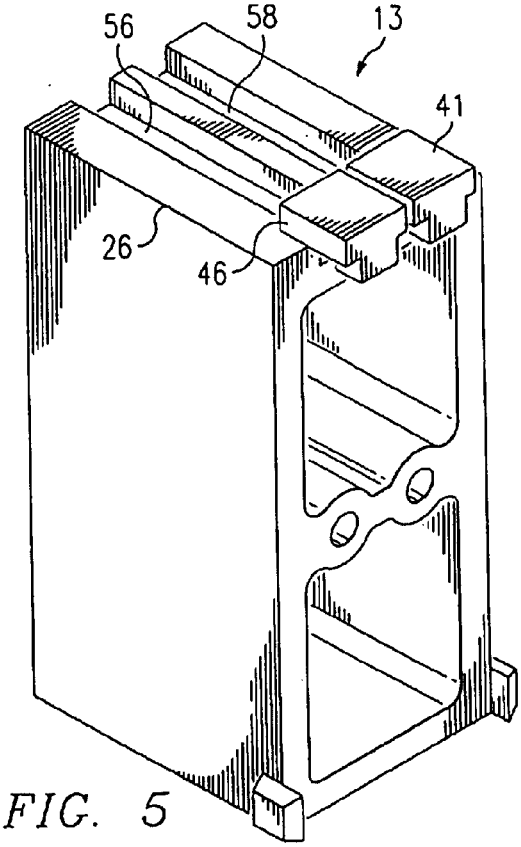
FIG. 5 is perspective rear view showing an alternate embodiment of the spacer block utilizing a plurality of tabs removably and slidably positional within grooves formed in the top surface of the spacer block.

The front face 12 is connected to a rear face 16 by a pair of spaced apart opposing side walls 18 to a top panel 20 and a bottom panel 22. The interconnecting side walls 18, top panel 20, and bottom panel 22 may have rounded shoulders 24 as shown in FIGS. 1–4 or squared shoulders 26 as shown in FIG. 5.

More particularly, the spacer block 11 can include a top cavity 34 and a bottom cavity 36 separated by a horizontally disposed medial wall 38 joining the front face 12 and rear face 16, defining a pair of sleeves having bores 18 therethrough. The corded-out cavities of the spacer block can be reinforced with webbing, solid block materials, gel material, foam, or liquids such as water, glycol, and mixtures thereof to aid in the dissipation of any stress.

An important feature of a preferred embodiment of the spacer block 11 of the present invention is a pair of mounting bores 28 formed in the spacer block 11 oriented along the horizontal axis, side by side, to facilitate aligning a bore 28 of the spacer block 11 with the offset hole 55 preformed in the typical metal I-beam 30. The bore 28 can be positioned for quick alignment and attachment of the spacer block 11 and guard rail 16 to the post 30.

More particularly, the spacer blocks 11 can include at least one and preferably a plurality of mounting bores 28 extending through the front face 12 for cooperative engagement of a corresponding bolt extending through the guard rail 14 and spacer block 11 for attachment to a post 30. In a preferred embodiment, the bore 28 extends through both the front face 12 and the rear face 16. Moreover, the bore 18 can extend through the medial wall 38 interconnecting the front face 12 and the rear face 16. It is contemplated that a sleeve 32 formed from a cylinder having a bore therethrough could be utilized as a removable spacer means for insertion between the hole formed in the front face 12 and rear face 16 abutting an interior surface of the front face 12, extending through the cavity formed in the interior of the block 11 to interconnect with the interior surface of the rear face 16 to provide additional structural support.

A feature which is very useful and adaptable to the various spacer block 11 embodiments are locating and holding means for cooperatively engaging the post 30 and/or guard rail 14.

The preferred embodiments of the spacer blocks 11 can include a top tab 40 fixedly attached to the top surface of the top panel 20. The tab 40 may also be provided as a removable or slidable tab having projections cooperatively engaging grooves formed in the channel 43 in a tongue and groove arrangement. The tabs 43 extend from past the rear face 22 of the spacer block for holding the spacer block 11 onto the top of a post 30. It is contemplated the tab 40 could comprise a flat plate or even a ring to engage a cylindrical post; however, the embodiment shown in FIGS. 1–5 includes projecting members or fingers 50 extending downward from the tab 40 mounted on the top of the block 11 extending past the rear face 22 enabling the tab 40 to set on top of an I-beam shaped post 30 with the fingers 50 extending behind the flanges 54 of the post 30 thereby holding the spacer block 11 securely to the post 30 for mounting.

Moreover, As shown in FIGS. 1–4 a groove or channel 43 can be formed or cut into the surface of the spacer block 11 top panel 20 to facilitate molding or handling of the blocks. As shown in the drawings, a leg 48 can extend from the bottom surface of the tab 40 to be supported by and preferably to connect with the top of the channel 43 in order to provide additional structural support for the tab 40.

As shown in FIG. 5, a first and second channel, 56 and 58 respectively, are formed in the top panel 20 of the spacer block 13. A pair of tabs 41 and 46 fixedly attached to the top surface of the top panel 20 extend past the rear face 22 of the spacer block for holding the spacer block 13 onto the top of a post 30. The tabs 41 and 46 may also be provided as a removable or slidable tab having projections cooperatively engaging grooves formed in the channels 56 and 58 in a tongue and groove arrangement. The tabs 41 and 46 extend from past the rear face 22 of the spacer block 13 for holding the spacer block 13 onto the top of a post 30. Thus, the top tab 42 allows the spacer blocks 13 to hang on the post 30 during mounting of the guard rail, post, and spacer block assembly.

A stop means may be incorporated within the channel or attached to the ends thereof to limit movement of a movable top tab 40, 41, and 46.

As shown in FIGS. 1–5, one or more optional side tabs 42 can be utilized with the spacer blocks 10 of the present invention for cooperatively engaging the post 30. FIGS. 6–14 show the use of side flanges 45. The side tabs 44 or side flanges 45 are spaced apart generally opposing one another and preferably in alignment with one another; however, it is not necessary that the side tabs 44 align with one another or that there be a corresponding number of side tabs on each side. Even one side tab 44 or side flange 45 aids in positioning the spacer blocks 10 with respect to the post 30. The side tabs 44 or side flanges 45 can be integrally formed within the spacer block 10 or attached by holding means such as a screw or projection engaging a hole formed in the spacer block 10. The spacer block 10 can be aligned in proper orientation by utilizing the side tabs 42 extending from the sides of the block 10.

A support tab 64 can be provided extending from the bottom panel 22 of the front face 12 for supporting a guard rail 14 resting thereon and aiding in the alignment of the bores 28 with holes in the guard rail 14 and post 30.

A recess or notch 60 can be formed or cut into the bottom edge panel 22 and rear face 16 of the spacer block 10 disposed therein for cooperatively engaging the support tab 64 permitting stacking and nesting of the spacer blocks 10 one upon the other for storage or transport.

Figure 6:
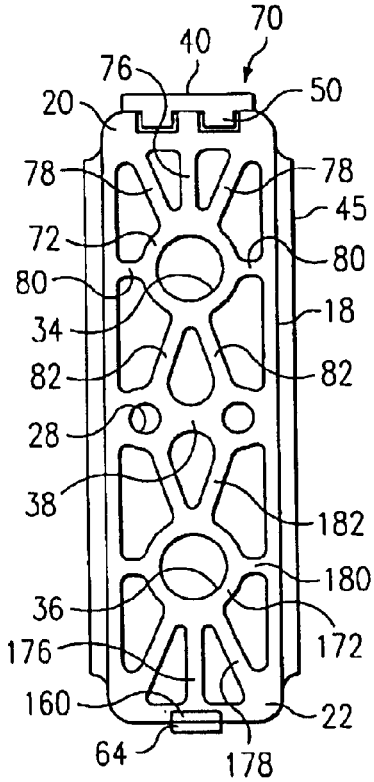
FIG. 6 is front view of an alternate embodiment of the spacer block showing webbing within the cavities.
Figure 4:
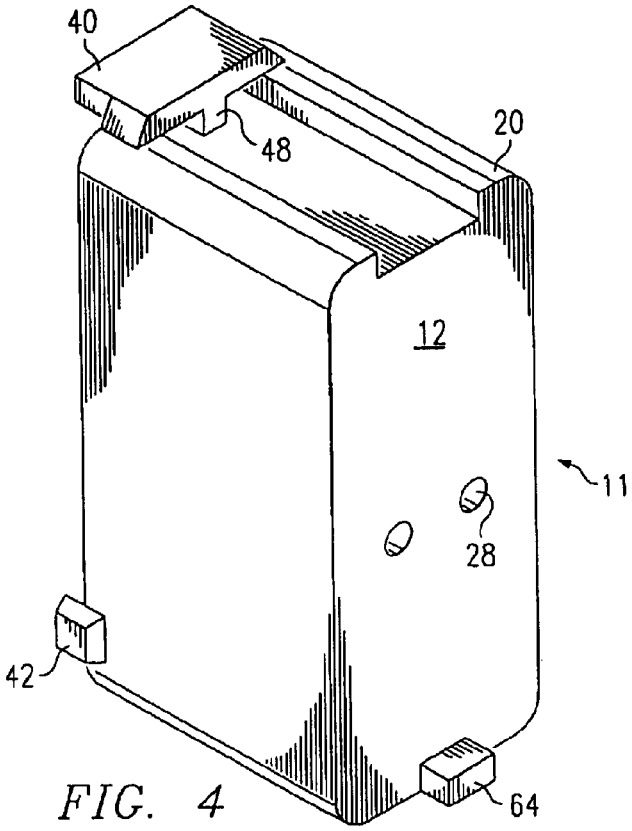
FIG. 4 is a front perspective view of FIG. 1 showing the flat face of the spacer block and guard rail support and positioning tab.
Figure 8:
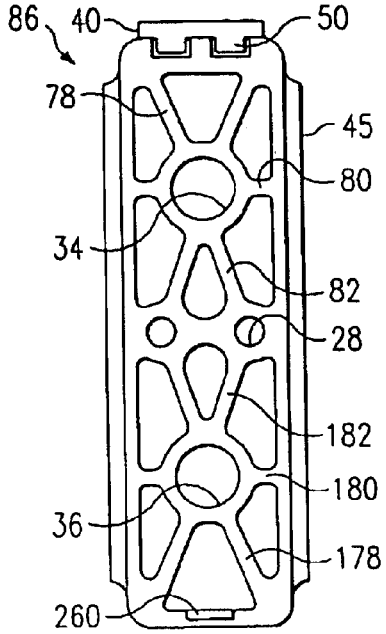
FIG. 8 is front view of an alternate embodiment of the spacer block showing a different webbing arrangement within the cavities.

The spacer blocks 10 of the present invention can be molded into specific embodiments maximizing structural integrity while maintaining controlled flexibility via reinforcing webbing and selecting particular rubber and thermoplastic compositions. FIGS. 6 and 8 show alternate embodiments of the spacer block of the present invention which utilize webbing within the top cavity 34 and bottom cavity 36 separated by a horizontally disposed medial wall 38 joining the front face 12 and rear face 16, defining a pair of sleeves formed as cylinders having bores 18 therethrough.

A preferred configuration of webbing design is shown in FIGS. 6 and 8, wherein the rear end of the spacer block shows webbing formed by various lengths of lateral, longitudinal, and transverse members having cavities therein between are formed to increase the structural strength while controlling compression and flexing forces and minimizing the weight of the spacer block.

As shown in FIG. 6, a spacer block 70 includes webbing which extends from the interior surface of the front face 12 through the cavity 34 or 36 having a distal end equal distance with the side walls 18 forming the rear face 16. Extending from the center of the interior surface of the front face 12 and through the first cavity 34 is a first cylindrical reinforcement member 72. A corresponding second cylindrical reinforcement member 74 extends from the interior surface of the front face 12 through the second cavity 36. In each cavity 34 and 36 respectively, the webbing comprises runners extending radially from a cylindrical reinforcing members 72, 74 to intersect with the interior surface of either the side wall 18, top panel 20, bottom panel 22, or medial wall 38.

As shown in FIG. 6, within the first cavity 34 a first runner 76 extends vertically from the top panel 20 to intersect with the cylindrical reinforcing member 72. A pair of second runners 78 extend radially from the cylindrical reinforcing member 72 toward the corners connecting the top panel 20 with the side wall 18. A pair of third runners 80 radiate horizontally from the cylindrical reinforcing member 72 toward the side walls 18. A fourth pair of runners 82 radiate downwardly from the cylindrical reinforcing member 72 toward the bores 28 in the medial wall 38 forming a tear drop shaped cavity thereinbetween.

Within the second cavity 36 of the spacer block 70 a first runner 176 extends vertically from the bottom panel 22 to intersect with the cylindrical reinforcing member 74. A pair of second runners 178 extend radially from the cylindrica reinforcing member 74 toward the corners connecting the top panel 20 with the side wall 18. A pair of third runners 180 radiate horizontally from the cylindrical reinforcing member 74 toward the side walls 18. A fourth pair of runners 182 radiate downwardly from the cylindrical reinforcing member 172 toward the bores 28 in the medial wall 38 forming a tear drop shaped cavity thereinbetween. Moreover, spacer block 70 can be formed or molded having a front face 12 which is slightly shorter than the rear face 16 so that the top panel 12 or bottom panel 22 incline toward one another slightly at the front face 12 to facilitate removing the spacer block from the mold. The notch (not shown) of the spacer block 70 is formed on the bottom of the bottom panel as a declining channel extending from the rear face 16 toward the front face 12 which does not extend through the interior surface of the bottom panel 22.

Figure 7:
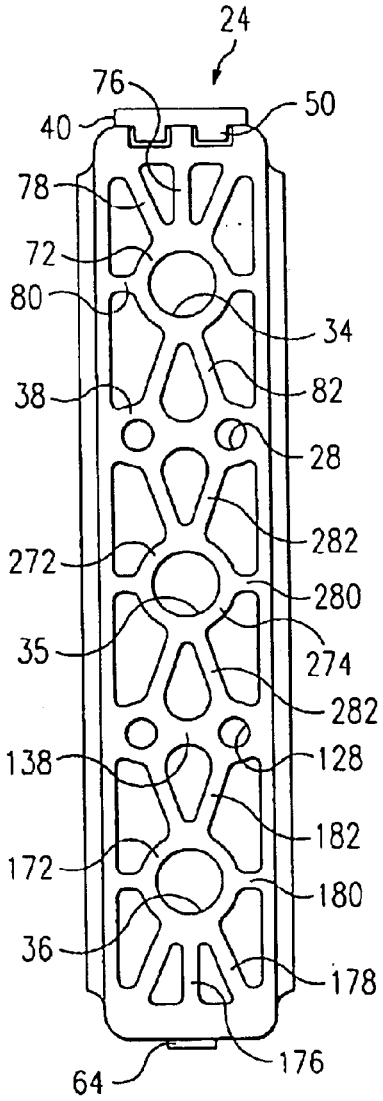
FIG. 7 is front view of an elongated embodiment of the spacer block utilizing the webbing arrangement of FIG. 6 for use with a thrie beam spacer block.
Figure 13:
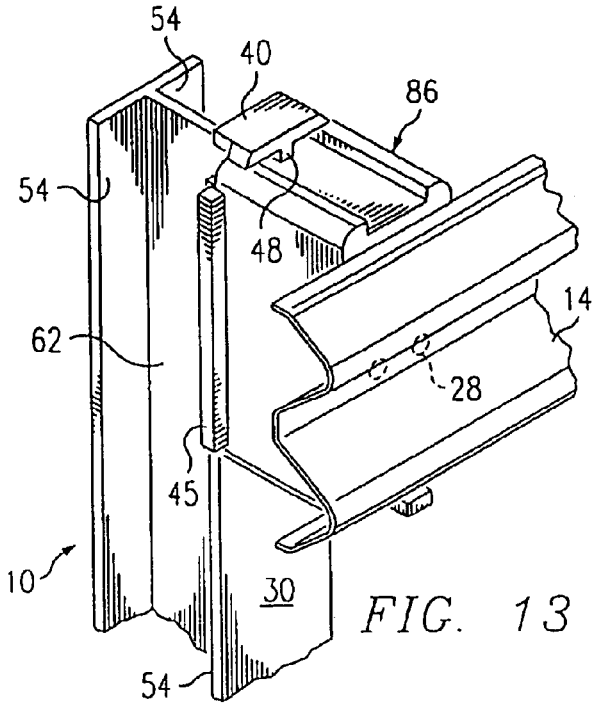
FIG. 13 is a perspective view showing the spacer block of FIG. 12 mounted to a post and cooperatively engaging a guard rail.
Figure 14:
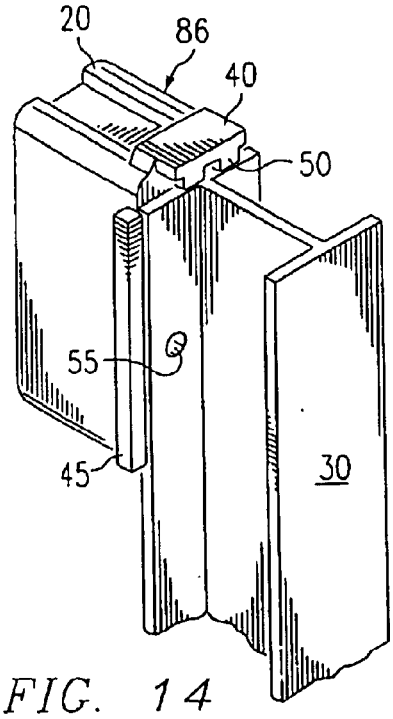
FIG. 14 is a rear perspective view showing the spacer block of FIG. 12 and the post.

FIG. 7 shows an alternate elongated embodiment of a spacer block 84 for use with thrie beam guard rails. The elongated spacer block 84 includes an additional third center cavity 35, medial wall 138 and bores 128, disposed between the first top cavity 34 and the second bottom cavity 36. The spacer block 84 utilizes substantially the same webbing configuration of the spacer block 70 of FIG. 6. The spacer block 84 is approximately 4 inches wide, about 21 inches long, and about 7½ to 8 inches thick. Of course, the depth and length dimension could vary on any of the spacer blocks 10 depending upon the dimensions of the selected guard rail; however, the four inch wide dimension, although not critical is preferably maintained at about 4 inches or equivalent to the thickness of the mounting post excluding the side rails 45 or side tabs 42.

Within the third center cavity 35 of the spacer block 84 is a pair of runners 278 radiating upwardly from the cylindrical reinforcing member 172 toward the bores 28 in the medial wall 38 forming a tear drop shaped cavity thereinbetween. A pair of runners 280 radiate horizontally from the cylindrical reinforcing member 274 toward the side walls 18. A pair of runners 282 radiate downwardly from the cylindrical reinforcing member 274 toward the bores 128 in the medial wall 138 forming a tear drop shaped cavity thereinbetween.

Figure 9:
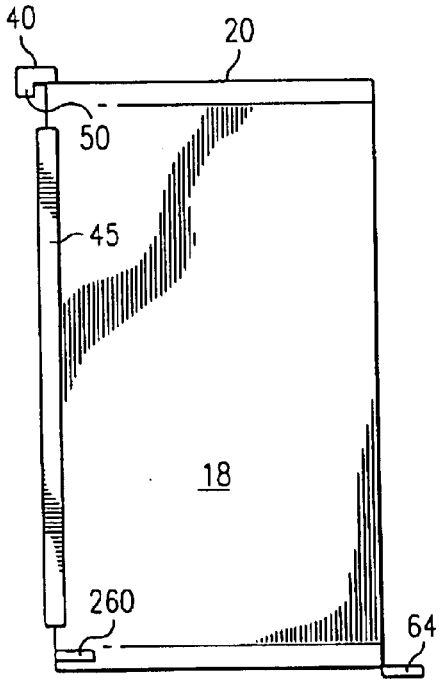
FIG. 9 is a side view of the spacer block of FIG. 8 formed of structural foam.

The spacer block embodiment 86 has similar dimensions, features, and webbing to that of the spacer block 84. As best illustrated in FIGS. 8 and 9, it differs from spacer block 84 in that spacer block 86 does not utilize runner 76 extending vertically from the top panel 20 to intersect with the cylindrical reinforcing member 74 or the vertical runner 176 extending vertically from the bottom panel 22 to intersect with the cylindrical reinforcing member 74. Moreover, the notch 260 is formed or cut into the bottom edge panel 22 and rear face 16 of the spacer block 10 forming a pocket, and does not cut through the bottom panel 22 exterior surface.

Figure 10:
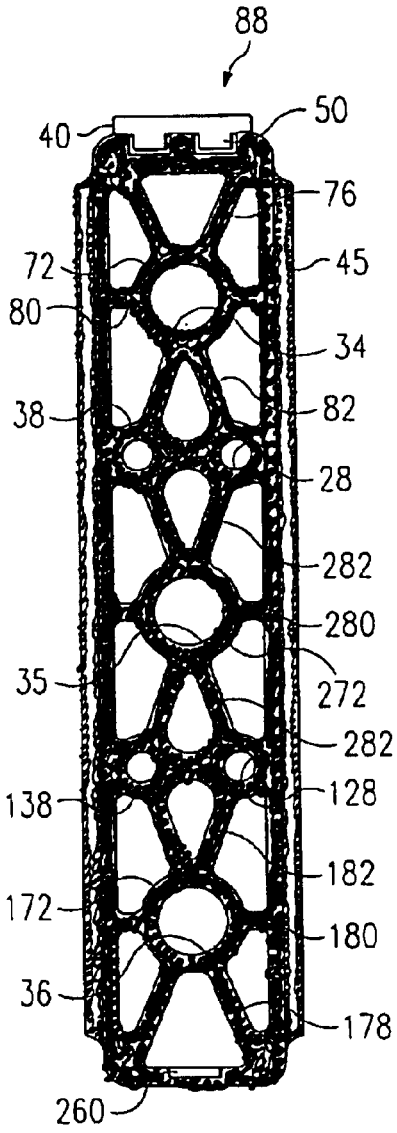
FIG. 10 is front view of an elongated embodiment of a spacer block utilizing the webbing arrangement of FIG. 8 for use with a thrie beam spacer block.

FIG. 10 shows an alternate elongated embodiment of the spacer block 86 for use with thrie beam guard rails. The elongated spacer block 88 includes an additional third center cavity 35, medial wall 138 and bores 128, disposed between the first top cavity 34 and the second bottom cavity 36. The spacer block 88 utilizes substantially the same webbing configuration of the spacer block 86 of FIG. 8. The spacer block 88 is approximately 4 inches wide, about 21 inches long, and about 7½ to 8 inches thick. Of course, the depth and length dimension could vary on any of the spacer blocks 10 depending upon the dimensions of the selected guard rail; however, the four inch wide dimension, although not critical is preferably maintained at about 4 inches or equivalent to the thickness of the mounting post excluding the side rails 45 or side tabs 42.

Structural Foam Spacer Blocks

Figure 11:
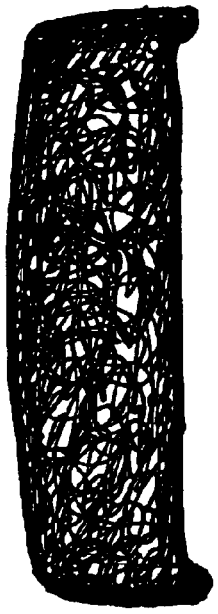
FIG. 11 is a sectional view of a portion of a block showing a cellular core and an integral solid skin on each side thereof.
Figure 12:
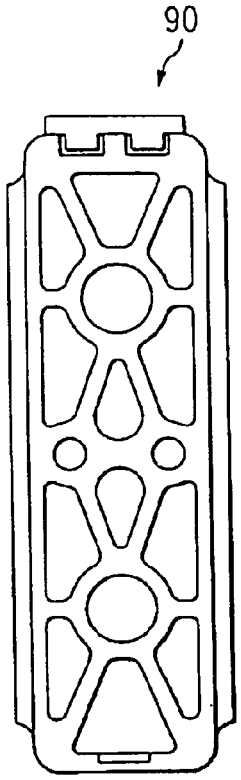
FIG. 12 is a sectional view along Section 9—9 of FIG. 9 showing a structural foam segment showing a cellular core and an integral solid skin, wherein the transition from skin to core is gradual.

The structural foam spacer blocks of the present invention are molded and have a cellular core and an integral solid skin, wherein the transition from skin to core is gradual as shown in FIG. 11. The solid skin gives the molded part its form and toughness, while the cellular core contributes to the high strength to weight characteristics. The skin of the structural foam spacer blocks can be up to ½ inch thick, more preferably up to ¼ inch thick and most preferably up to ⅛ inch thick. There are two basic types of plastics available for foaming. Thermoset materials such as polyurethane is produced by polyaddition of reactive components such as polyol and isocyanate. The exotherm generated by the reaction vaporizes a blowing agent that causes the mixture to expand. Thermoplastic materials typically require the addition of physical or chemical blowing agents to product a foam and do not undergo chemical change. Some blowing agents decompsoe when heated to process temperature to evolve a gas such as carbon dioxide. Often sodium bicarbonate or ammonium carbonate is used for cellular or sponge rubber, halocarbons and methylene chloride is used in urethane, pentane in expanded polystyrene, and in some cases hydrazine for foamed plastics.

Spacer blocks utilizing plastic and/or rubber components formed with solid walls usually does not exceed 4 mm (0.16 inches). The wall thickness of the spacer block composed of plastic and/or rubber components is usually not less than about 4 mm in order to gain the full advantage of the foam webbing structure between the two layers of skin. Thus, thick wall thicknesses may be obtained using structural foam. Moreover, structural foam spacer blocks have few if any sink marks due to the residual gas pressure in the cells, which allows the material to expand internally while the part cools, thus holding the skin firmly against the mold walls. Because of their cellular structure the spacer blocks formed of structural foam are virtually stress-free, resulting in bowing and warpage being greatly reduced. Because of its cellular structure, less resin is used to make it resulting in a part 3 to 4 times more rigid than the solid part of the same weight. This enables the instant invention to be made of commodity plastics such as polystyrene and polyethylene with or without rubber in a load bearing application.

The properties of the structural form spacer block depends on the base polymer, overall part density, density distribution, skin thickness, cell shape and size. All of these parameters are affected by the processing method, process variables, wall thickness, and mold design.

Density of the structural foam varies across the cross section and is lowest in the core. As the distance from the center of the foamed block increases, the cells get smaller until they disappear completely in the outer skin. The objective is to produce a part with high skin density and very low core density without the presence of voids. The range of the density varies in the present invention from about 30 percent in the center to 100 percent at the outer skin. Moreover, the overall part density, density distribution, skin thickness, cell shape and size depend upon the mold cycle which may vary between ½ to 10 minutes.

A preferred embodiment of the spacer block of the instant invention is processed using a low pressure injection molding machine using thermoplastics and/or rubber. A screw is used to plasticate a mixture of polymer and chemical blowing agent of up to 1% and preferably up to ½ percent wherein the screw barrels has zones at different temperatures arranged so that the blowing agent in only near the nozzle. A foamable mixture is produced and pumped under pressure to an accumulator an stored in a molten state at a pressure higher than the foaming pressure. Upon opening a valve in the nozzle, a portion of the foamable mixture is discharged from the accumulator into the mold. The mold cavity is filled by the gases generated by the decomposition of the chemical blowing agent forcing the material into the shape of the mold. The pressure and temperature of the material in the mold drop resulting in bubbles developing in the core. In a preferred embodiment, the melt is charged at about 400° F. and the melt temperature is between about 380° to 450° F. It should be noted that the structural foam blocks 10 of the present invention can be made utilizing of a rubber compound in combination with a plastic. The plastic tends to encapsulate the rubber particles and act as a binder. The rubber produces enough gas during processing under the heat and pressure of the low pressure injection molding process that the structural foam product can be made without the addition of any type of chemical blowing agent.

The spacer block of the present invention may be formed by injection molding, and preferably low pressure injection molding such as is used for structural foam products. The spacer block can be comprised of a virgin or regrind plastic or combinations thereof without any rubber. The plastic may be selected from the following polymers: polyethylene, polypropylene, polyethylene terephthalate, nylon, polyurethane, polyvinyl chloride, ABS, Acetyl, polypropylene oxide, nylon, PBT, polycarbonate, polystyrene, modified polyphenylene oxide, polyester, fiberglass filled nylon, fiberglass filled styrene, fiberglass filled SAN, acrylic, ethylene copolymers, ionomers, and polysulfone. Of course the spacer block of the present invention may be formed of a single type of polymer or mixtures of various polymers. Typically a chemical blowing agent in an amount of less than 5 percent, and more preferably in an amount of less than 1 percent and most preferably in amount of less than ½ percent can be used with the 100% polymer composition spacer blocks 10.

A rubber and/or elastomeric compound can be incorporated in the formulation as a substitution for up to at 70 percent, and more preferably at less than 50% and most preferably from about 40 to 50 percent depending upon the strength to weight ratio desired and the structural properties required for a particular application or size of guard rail. Regrind rubber is typically less expensive than plastic materials therefor, as much as 40 to 50 percent rubber may be used in spacer blocks for normal impact applications or posts spaced closed together, whereas a composition with less than 45 percent rubber may be desired for applications requiring the posts to be spread further apart from one another. The type of rubber is also an important consideration in that the rubber may be comprised of a natural rubber or synthetic rubber, either virgin, regrind material or combinations thereof. Additives such as fillers and fiberglass may further reduce the cost of manufacture and provide the requisite strength. Moreover, because of the gases produced from injection molding the rubber particles, the use of a chemical blowing agent is an option and is not required when processing the plastic and rubber mixed compositions.

A particular preferred embodiment comprises polyethylene together with grind rubber ranging in an amount of up to 45 percent. Yet another more preferred embodiment utilizes from about 30 to 45 percent regrind rubber and utilizes ethylene as the binding polymer.

Another preferred embodiment utilizes a powdered processing aid from Polymer Process Technologies, Inc. in Akron, Ohio referred to by the trademark PPT-SYS, (PPT-SYS(R) for rubber applications and PPT-SYS(P) for plastic applications), having a specific gravity of about 1.01, pH of about 7, melting point range of over 600° F. which is a highly effective alloying agent for compatibilizing and alloying cured rubber, virgin or regrind, with plastic powder to form compounds having little or no change in physical properties.

Moreover, another preferred embodiment may contain a nontoxic blend of naturally occurring materials, (plant polymers, gums, and anionic salts), marketed by Polymer process Technologies, Inc, under the trademark of PPT-RNU that when added to post consumer plastics of all kinds, will repair heat history plastics to near virgin polymer condition. in addition to or instead of the PPT-SYS (R)/(P). The material has a pH of about 6.8, a specific gravity of about 1.05, a melt point flow of over 650° F. and used in amounts of up to 10% by weight and more preferably from about 3 to about 6% by weight.

Another preferred embodiment utilizes both the PPT-RNU and PPT-SYS additives with rubber and a polymer such as polyethylene to enhance the compatibility and performance of regrind rubber from tires being compounded with virgin or recycled polymers such as polyethylene in conventional compounding equipment at processing temperatures of from about 360° to 410° F. which is typical for extrusion and compounding operations.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented hereinabove. Rather, what is intended to be covered is within the spirit and scope of the appended claims.

I claim:

1. A spacer block for attaching a guard rail to a post, comprising:

a pair of spaced apart opposing side walls having respective first ends and second ends;

a top panel disposed proximate said first end of said side walls;

a bottom panel disposed proximate said second end of said side walls;

said top panel said bottom panel and side walls forming a generally rectangular block having a first front face and a second rear face;

an engagement mechanism operably coupled proximate said top panel, said engagement mechanism operable to engage said block with said post, the engagement mechanism including a tab operably coupled to the top panel, the tab extending beyond the second face of the spacer block, at least two spaced apart fingers operably coupled proximate a distal end of the tab, the fingers extending from a bottom surface of the tab and forming a gap between the fingers and the second face of the spacer block, the gap between the fingers operable to engage respective sides of a web on an I-beam support post and the gap between the fingers and the second face of the spacer block operable to engage respective sides of a flange on the I-beam support post;

resting mechanism operably coupled proximate said bottom panel for supporting a bottom edge of a guard rail thereon;

at least one mounting bore extending there through from said first front face to said second rear face; and an alignment mechanism operably coupled to at least one side wall.

2. The spacer block of claim 1 comprising a thermoplastic polymer and a rubber material.

3. The spacer block of claim 1, comprising a structural foam thermoplastic composition.

4. The spacer block of claim 1, comprising a structural foam thermoplastic and rubber composition.

5. The spacer block of claim 1, further comprising:

a medial wall disposed between the side walls, the medial wall positioned generally perpendicular to the side walls and generally parallel to the top and bottom panels;

the medial wall, top panel and side walls forming a first cavity; and the medial wall, bottom panel and side walls forming second cavity.

6. The spacer block of claim 5 further comprising:

at least one mounting bore traveling through the medial wall from the first face of the spacer block to the second face of the spacer block; and the mounting bore operable to align with at least one mounting aperture on the support post.

7. The spacer block of claim 5 further comprising a reinforcement structure disposed in at least one of the cavities.

8. The spacer block of claim 5 further comprising a webbing structure disposed within at least one of the cavities, the webbing structure operable to structurally reinforce the spacer block.

9. The spacer block of claim 1 further comprising:

at least one mounting bore disposed in the first medial wall, the mounting bore traveling between the first and second faces of the spacer block; and at least one mounting bore disposed in a second medial wall, the mounting bore traveling between the first and second faces of the spacer block.

10. The spacer block of claim 1 further comprising:

said resting mechanism including a tab disposed proximate the bottom panel, said tab extending from the first face of the spacer block.

11. The spacer block of claim 1 wherein said alignment mechanism operably coupled to at least one side wall is at least one tab projecting past said rear face for cooperatively engaging said post.

12. The spacer block of claim 1 further comprising the first face including a generally flat solid surface.

13. The spacer block of claim 1 further comprising the bottom panel including a notch disposed proximate the second face of said spacer block, said notch operable to allow stacking of said spacer blocks.

14. The spacer block of claim 1 wherein said spacer block is formed using an injection molding process.

15. The spacer block of claim 1 wherein the spacer block is formed at least in part, using a structural foam.

* * * * *